US006524143B2

(12) United States Patent
Chen

(10) Patent No.: US 6,524,143 B2
(45) Date of Patent: Feb. 25, 2003

(54) FEMALE CRIMP TERMINAL

(75) Inventor: Ping Chen, West Bloomfield, MI (US)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/022,111

(22) Filed: Dec. 13, 2001

(65) Prior Publication Data

US 2002/0077001 A1 Jun. 20, 2002

(30) Foreign Application Priority Data

Dec. 18, 2000 (JP) ..... 2000-384453

(51) Int. Cl.[7] ..... H01R 11/22
(52) U.S. Cl. ..... 439/852
(58) Field of Search ..... 439/839, 841, 439/851, 852

(56) References Cited

U.S. PATENT DOCUMENTS 3,836,947 A * 9/1974 Yeager ..... 439/839
5,188,545 A * 2/1993 Hass et al. ..... 439/851
5,443,592 A * 8/1995 Ittah et al. ..... 439/839
5,562,501 A 10/1996 Kinoshita et al.
5,643,018 A 7/1997 Sakai et al.
5,741,163 A * 4/1998 Hotea ..... 439/852
5,941,741 A * 8/1999 Dobbelaere et al. ..... 439/852
6,042,433 A * 3/2000 Chen ..... 439/852
6,152,788 A 11/2000 Hata et al.
6,227,915 B1 * 5/2001 Sakatani et al. ..... 439/752.5
6,290,553 B1 9/2001 Sato et al.

FOREIGN PATENT DOCUMENTS

JP 09147950 6/1997

OTHER PUBLICATIONS

"Female Terminal", by Ping Chen. U.S. patent application 10/022,110; Dec. 13, 2001, pp. 1 to 24 and 9 sheets of drawings.

* cited by examiner

*Primary Examiner*—Gary Paumen
*Assistant Examiner*—James R. Harvey
(74) *Attorney, Agent, or Firm*—W. F. Fasse; W. G. Fasse

(57) ABSTRACT

A female crimp terminal includes a tubular body, a leaf spring contact inside the body and integrally extending from the front part of the body, a neck having a U shape when seen in the longitudinal direction and integrally extending from the lower parts of both side walls and the bottom wall at the rear end of the body, and a barrel having a U shape when seen in the longitudinal direction, integrally extending from the neck and having retainers extending upward high above the neck. A notch is made in a rear edge of each side wall from the rear end of the body so as to divide the side wall into an upper part and a lower part. This isolates crimping forces of the barrel from the tubular body which houses the leaf spring contact.

9 Claims, 5 Drawing Sheets

FEMALE CRIMP TERMINAL

CROSS-REFERENCE TO RELATED APPLICATION

This application is related to my copending U.S. patent application Ser. No. 10/022,110, filed on Dec. 13, 2001.

BACKGROUND OF THE INVENTION

1. Field of the Invention

The present invention belongs to a technical field of female crimp terminals to be fitted in housings of female connectors and relates to measures to prevent the body of a female crimp terminal from deformation.

2. Related Art

A female crimp terminal is known, wherein a leaf spring is provided inside a tubular body into which a male terminal is inserted through a front opening of the tubular body, and the body is integrally provided with a barrel with a neck between the body and the barrel. In the case of the female crimp terminal that is disclosed by Japanese Patent unexamined publication gazette Heisei 9-147950, the body comprises a bottom wall, side walls rising from both ends, in the width direction, of the bottom wall, and upper walls extending sidewise from the upper ends of the side walls. The neck is formed approximately into a U shape when seen in the front-rear or longitudinal direction, and is integrally formed on the lower parts of both side walls and the bottom wall at the rear end of the body. The barrel is formed approximately into a U shape when seen in the longitudinal direction, and is integrally formed on the neck and has retainers extending upward high above the neck.

In the female crimp terminal as described above, when an electric wire is to be crimped onto the barrel, the upper ends of the barrel will be bent inward, and the bending force will be transmitted through the neck to the rear end of the body and the body may be deformed. This deformation of the body will take place in the form of, for example, bending of the side walls or expansion of the upper walls. Should this happen, when the female crimp terminal is to be inserted into a cell of the housing, the resistance to the insertion may be greater or it may be impossible to insert the female crimp terminal into the housing. In particular, when the female crimp terminal is compactified by shortening the longitudinal length of the neck, this defect will be conspicuous.

SUMMARY OF THE INVENTION

The present invention was made in view of these points, and one objective of the invention is to prevent the bending force applied to the barrel from being transmitted to the upper parts of the rear ends of the side walls by making a notch in each side wall from the rear end of the body so as to divide the side wall into an upper part and a lower part, to secure strength of the neck and secure the function of the leaf spring, to prevent bending of the upper parts of the side walls and expansion of the upper wall, in turn, to ensure smooth insertion of the female crimp terminal into a cell of the housing, and to enable compactification of the female crimp terminal by shortening the longitudinal length of the neck.

To accomplish the above-mentioned objective, the female crimp terminal of the present invention comprises a tubular body that has a bottom wall, side walls rising from both ends, in the width direction, of the bottom wall, and an upper wall extending sidewise from the upper end of the side wall, into which a male terminal is to be inserted through a front opening thereof, a leaf spring being located inside the body and being integrally formed on the front part of the body, a neck being formed approximately into a U shape when seen in the longitudinal direction and being integrally formed on the lower parts of the side walls and the bottom wall at the rear end of the body, and a barrel being formed approximately into a U shape when seen in the longitudinal direction, being integrally formed on the neck and having retainers extending upward high above the neck, and a notch is made in each side wall from the rear end of the body so as to divide the side wall into an upper part and a lower part.

In this female crimp terminal, if an electric wire, of which insulation is removed to expose the core, is placed in the cavity of the barrel and the retainers of the barrel are bent inward, the electric wire will be crimped in the barrel. If the female crimp terminal is inserted into the housing, and a male terminal is inserted into the body of the female crimp terminal, the male terminal will be inserted between the inside wall of the body and the leaf spring and connection between both terminals will be made. In that case, the bending force, which is generated when the retainers of the barrel are bent inward during crimping, will be transmitted via the neck to the rear end of the body. However, as each side wall is divided into an upper part and a lower part by the notch at the rear end thereof, the above-mentioned bending force will not affect the upper part of each side wall at the rear end of the body. Thus bending of the upper parts of side walls and expansion of the upper wall at the rear end of the body will be prevented. Accordingly, the insertion resistance when the female crimp terminal is inserted into the cell of the housing will not increase, and the female crimp terminal can be inserted smoothly into the cell of the housing. As the notches are not made in the neck itself or the notches are not made vertically between the neck and the body, the strength of the neck is secured. The above-mentioned bending force will be transmitted to the lower parts of the side walls at the rear end of the body. However, the insertion resistance when the female crimp terminal is inserted into the cell of the housing does not increase since the lower parts of the side walls at the rear end of the body are integrally formed on the bottom wall and have a higher rigidity than the upper parts, and even if the lower parts are deformed, they will be concaved inwardly. As the leaf spring is integrally formed on the front part of the body, the decrease in the rigidity resulting from making the notches does not affect the function of the leaf spring. Since the bending of the upper parts of the side walls and expansion of the upper wall at the rear end of the body are prevented as explained above, the female crimp terminal can be compactified by shortening the longitudinal length of the neck. As the upper wall is not worked, a retainer may be fitted on the upper side of the neck.

In the female crimp terminal according to the present invention a notch is made in each side wall at the rear end of the body to divide the side wall into an upper and a lower part so as to prevent the force for bending the barrel from being transmitted to the upper part of the side wall at the rear end, to prevent bending of the upper part of the side wall and expansion of the upper wall while securing the strength of the neck and securing the function of the leaf spring, and in turn, to eliminate any increase in insertion resistance when the female crimp terminal is inserted into a cell of the housing and ensure smooth insertion of the female crimp terminal into the cell of the housing. In turn, the female crimp terminal can be compactified by shortening the longitudinal length of the neck. As the upper wall is not worked, a retainer can be fitted onto the upper side of the neck.

DESCRIPTION OF THE PREFERRED EMBODIMENT OF THE INVENTION

Figure 1:
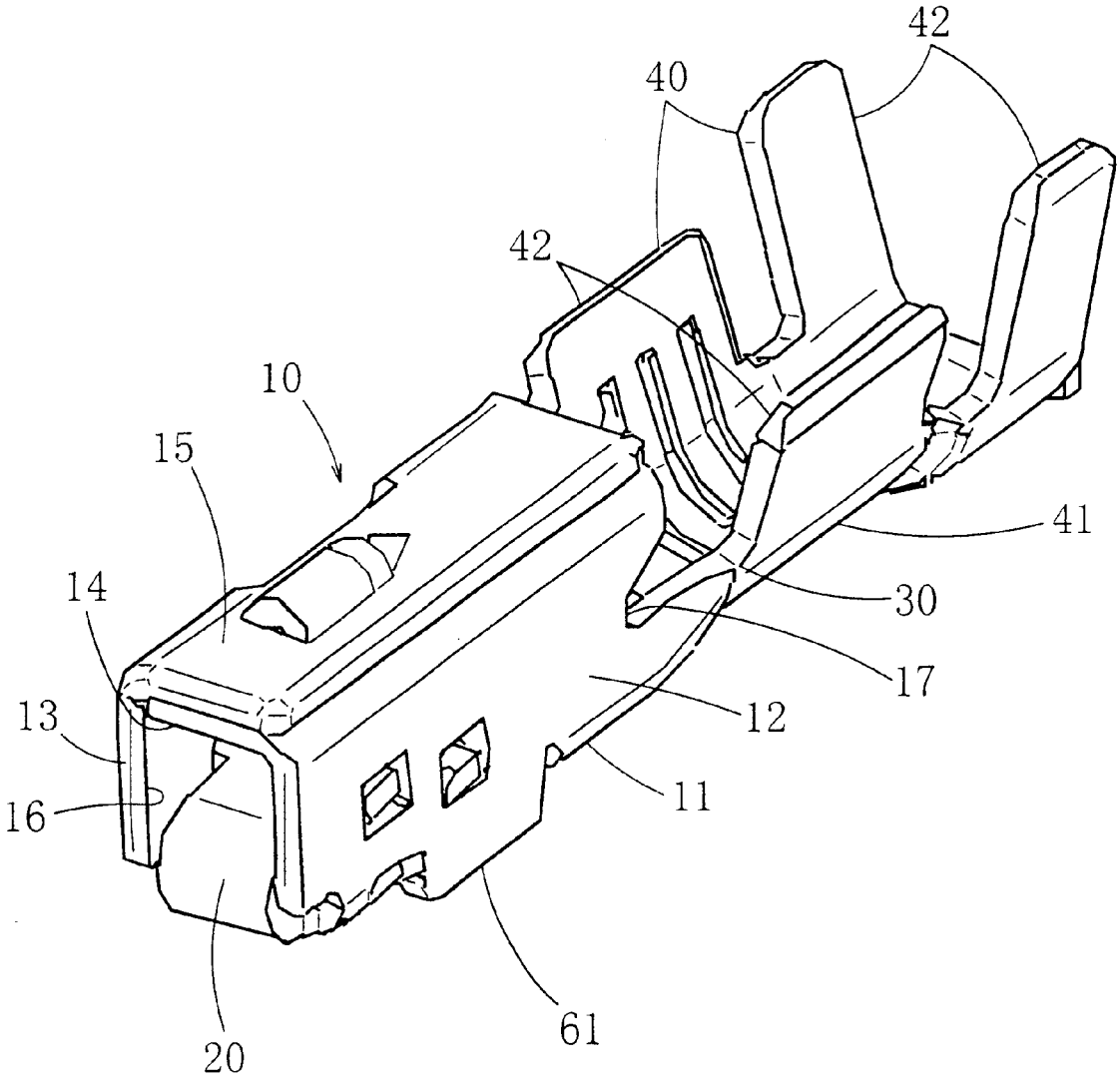
FIG. 1 is a perspective view of the female crimp terminal of one embodiment of the invention.
Figure 2:
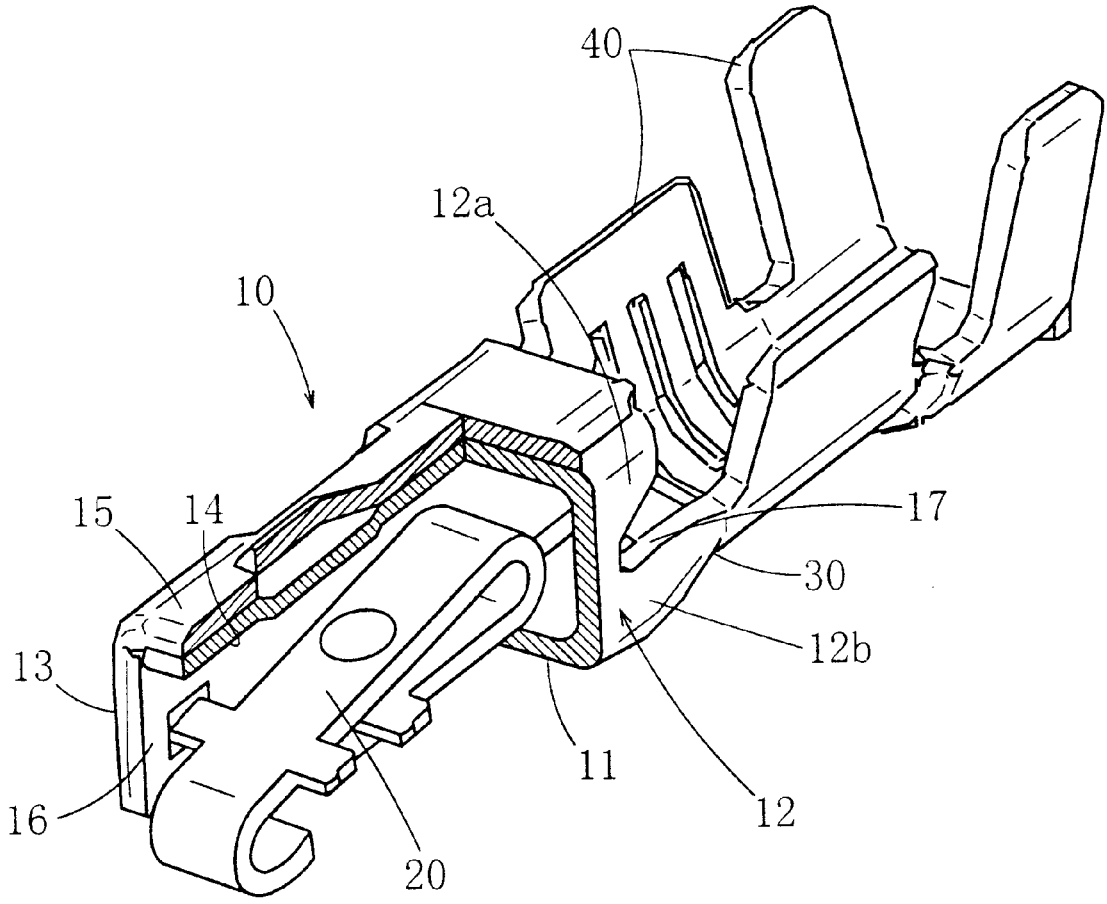
FIG. 2 is a perspective view showing the above-mentioned female crimp terminal of which a portion is partly removed.
Figure 3:
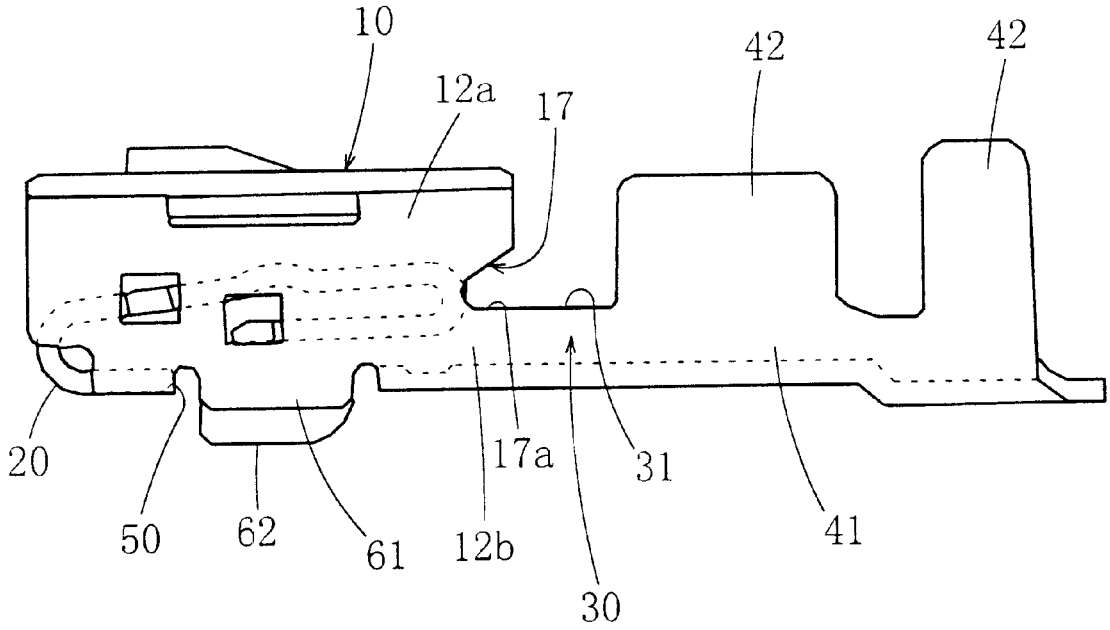
FIG. 3 is a right side view of the above-mentioned female crimp terminal.
Figure 4:
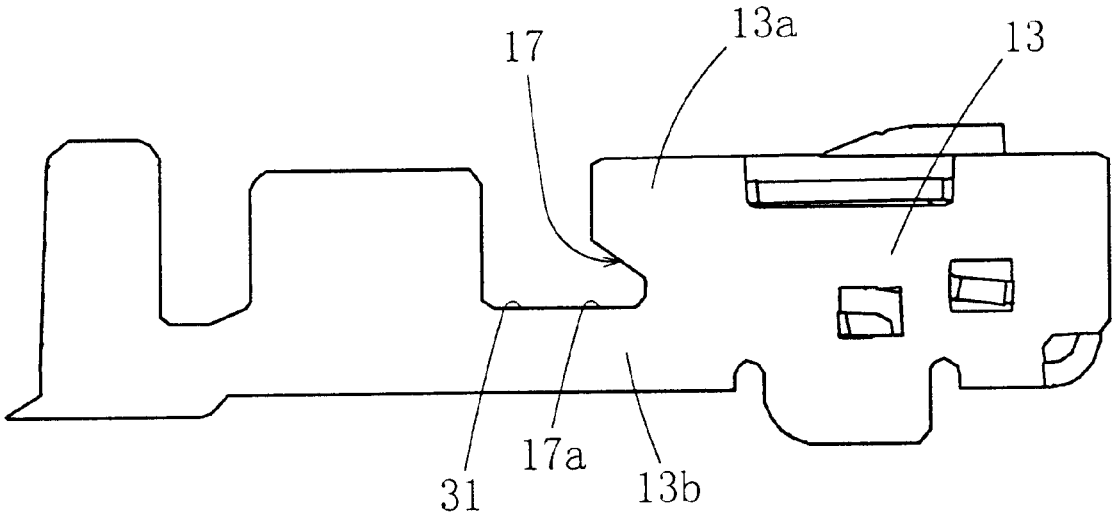
FIG. 4 is a left side view of the above-mentioned female crimp terminal.

In the following, some embodiments of the present invention will be described with reference to the attached drawings. FIG. 1 through FIG. 4 show an embodiment of the female crimp terminal.

This female crimp terminal comprises a tubular body 10 into which a male terminal is fitted through a front opening 16 thereof, and a leaf spring 20 being located inside the body 10. The body 10 has a bottom wall 11, side walls 12, 13 rising from both ends, in the width direction, of the bottom wall 11, and upper walls 14, 15 extending sidewise from the upper ends of the side walls 12, 13. An opening 16 is formed by the walls 11 through 15 at the front end. In the case of the present embodiment, the body 10 is formed by folding a piece of plate. The first upper wall 14 extends sidewise from the upper end of one side wall 12, and the second upper wall 15 extends sidewise from the upper end of the other side wall 13 and overlaps with the first upper wall 14 from above. The present invention includes embodiments wherein only either one of the two upper walls that are exemplified herein is used as the upper wall, and embodiments wherein two upper walls are not overlapped with each other but butted against each other.

The leaf spring 20 is integrally formed on the front part of the body 10. In the case of the present embodiment, one end of the leaf spring 20 is integrally formed on the front end of the bottom wall 11 of the body 10, and the other end is bent upward and rearward to extend rearward and then it is bent downward and forward to extend forward. The present invention is not limited to the present embodiment, and covers extensively female crimp terminals having a leaf spring that is arranged inside the body and is integrally formed on the front part of the body.

A neck 30, which is formed approximately into a U shape when seen in the longitudinal direction, is provided on the rear end of the body 10. The neck 30 is integrally formed on the lower parts 12*b*, 13*b* of both the side walls 12, 13 and the bottom wall 11 at the rear end of the body 10.

A barrel 40, which is formed approximately into a U shape when seen in the longitudinal direction, is provided at the rear of the neck 30. The barrel 40 comprises a base 41, which is integrally formed on the rear end of the neck 30, and retainers 42, which are integrally formed on the upper sides of the base 41 and extend upward high above the neck 30. The barrel 40 of this embodiment comprises a wire barrel, which is provided at the front to crimp the core of an electric wire 70, and an insulation barrel, which is provided at the rear to crimp the insulation of the electric wire 70. Hence a total of four retainers 42 extend upward from the upper parts of the base 41 at four points, the front right and left and the rear right and left.

In the case of this female crimp terminal, notches 17 are made in the side wall 12, 13 at the rear end of the body 10 so to divide the side wall 12, 13 into upper parts 12*a*, 13*a* and lower parts 12*b*, 13*b*, respectively. the lower edge 17*a* of each notch 17 is made continuous to the upper edge 31 of the neck 30 to avoid any difference in level.

The structure for fitting this female crimp terminal in a housing is discretionary, but in the case of this embodiment, the cell of the housing is provided with a flexible piece, which has flexibility and of which a top end flexes in the vertical direction, and this flexible piece is made to fit onto the female crimp terminal. To this end, a flexible-piece-receiving hole 50 is opened in the bottom wall 11. 61, 62 denote guide pieces, which extend downward from the bottom wall 11. When the female crimp terminal is to be inserted into the housing, the guide pieces 61, 62 exhibit a function of guiding the insertion of the female crimp terminal by fitting into guide grooves formed in the housing and a function of preventing reverse insertion. These guide pieces are provided when needed.

The method of forming this female crimp terminal is discretionary, but in the case of the present embodiment, the female crimp terminal is formed from a single metal plate. A plurality of female crimp terminals, which are formed in a developed state, are blanked out of a metal plate, the female crimp terminals being connected by runners. Then various parts are bent to form the female crimp terminals into the final shape. After that, the respective female crimp terminals are cut away from the runners.

Figure 5:
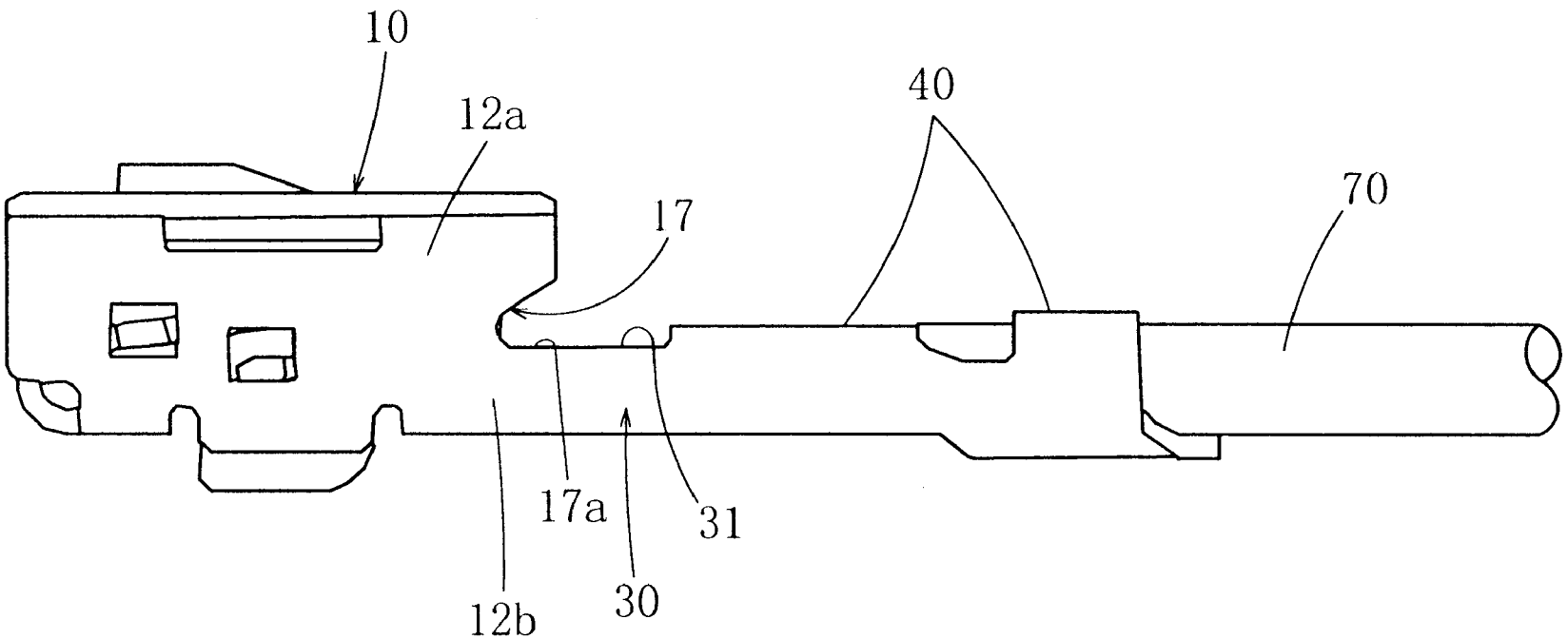
FIG. 5 is a side view of the above-mentioned female crimp terminal with an electric wire crimped therein.

Accordingly, in the case of the female crimp terminal of the above-mentioned embodiment, if an electric wire 70, of which insulation is removed to expose the core, is placed in the cavity of the barrel 40 and the retainers 42 of the barrel 40 are bent inward, the electric wire 70 will be crimped in the barrel 40 (refer to FIG. 5). If the female crimp terminal is inserted into the housing, and a male terminal is inserted into the body 10 of the female crimp terminal, the male terminal will be inserted between the inside wall of the body 10 and the leaf spring 20 and connection between both terminals will be made. In that case, the bending force, which is generated when the retainers 42 of the barrel 40 are bent inward during crimping, will be transmitted via the neck 30 to the rear end of the body 10. However, as the side walls 12, 13 at the rear end of the body 10 are divided into upper parts 12*a*, 13*a* and lower parts 12*b*, 13*b* by notches 17, the above-mentioned bending force will not affect the upper parts 12*a*, 13*a* of the side walls 12, 13 at the rear end of the body 10. Thus bending of the upper parts 12*a*, 13*a* of the side walls 12, 13 at the rear end of the body 10 and expansion of the upper walls 14, 15 at the rear end of the body 10 will be prevented. Hence the insertion resistance when the female crimp terminal is inserted into the cell of the housing will not increase, and the female crimp terminal can be inserted smoothly into the cell of the housing. As the notches 17 are not made in the neck 30 itself or the notches 17 are not made vertically between the neck 30 and the body 10, the strength of the neck 30 is secured. The above-mentioned bending force will be transmitted to the lower parts 12*b*, 13*b* of the side walls 12, 13 at the rear end of the body 10. However, the insertion resistance when the female crimp terminal is inserted into the cell of the housing does not increase since the lower parts 12*b*, 13*b* of the side walls 12, 13 at the rear end of the body 10 are integrally formed on the bottom wall 11 and have a higher rigidity than the upper parts 12*a*, 13*a*, and even if the lower parts 12*b*, 13*b* are deformed, they will be concaved inwardly. As the leaf spring 20 is integrally formed on the front part of the body

10, the decrease in the rigidity resulting from making the notches 17 does not affect the function of the leaf spring 20. Since bending of the upper parts 12*a*, 13*a* of the side walls 12, 13 and expansion of the upper walls 14, 15 at the rear end of the body 10 are prevented as explained above, the female crimp terminal can be compactified by shortening the longitudinal length of the neck 30. As the upper walls 14, 15 are not worked, a retainer may be fitted on the upper side of the neck 30.

The present invention includes all embodiments wherein notches are made in the side walls to separate the upper parts and the lower parts. However, as is the case of the above-mentioned embodiment, if the lower edges 17*a* of the notches 17 are made continuous to the upper edges 31 of the neck 30 so that there is no difference in level, when the bending force is transmitted from the neck 30 to the body 10, the bending force will not work concentratedly on parts between the lower edges 17*a* of the notches 17 and the upper edges 31 of the neck 30, and deformation of these parts can be prevented.

With the description of these embodiments, the first female crimp terminal, which was described in the summary of the invention, has been fully disclosed. Furthermore, with the description of these embodiments, the second female crimp terminal, which is summarized below, has also been fully described.

The second female crimp terminal is a female crimp terminal as recited in the first female crimp terminal wherein the lower edge of each notch is made continuous to the upper edge of the neck so that there is no difference in level. With this arrangement, when the bending force is transmitted from the neck to the body, the force will not work concentratedly on parts between the lower edges of the notches and the upper edges of the neck and deformation of these parts can be prevented.

What is claimed is:

1. A crimpable female electrical terminal comprising:

an electrically conductive tubular body including a bottom wall, an upper wall spaced above said bottom wall, and two side walls spaced laterally from each other and respectively extending between said bottom wall and said upper wall, wherein a terminal cavity is formed within said tubular body between said bottom wall, said upper wall and said side walls, wherein said tubular body extends in a longitudinal direction from a front end of said tubular body defined by front edges of said side walls, said bottom wall and said upper wall to a rear end of said tubular body defined by rear edges of said side walls and said upper wall, wherein said tubular body has rigidity from said front end to said rear end, wherein a respective notch is provided in each one of said rear edges of said side walls such that each said notch extends from a respective one of said rear edges in said longitudinal direction toward said front end so as to divide a respective rear portion of each respective one of said side walls into an upper side wall portion between said notch and said upper wall and a lower side wall portion between said notch and said bottom wall;

an electrically conductive spring contact element integrally extending from said front end of said tubular body into said terminal cavity in said longitudinal direction toward said rear end of said tubular body;

an electrically conductive neck including a bottom neck wall integrally extending in said longitudinal direction from said bottom wall at said rear end of said tubular body, and two side neck walls integrally extending in said longitudinal direction from said lower side wall portions at said rear end of said tubular body, wherein said side neck walls and said bottom neck wall together form a U-shape on a section plane perpendicular to said longitudinal direction; and an electrically conductive crimpable connection barrel including a bottom barrel wall integrally extending from said bottom neck wall in said longitudinal direction away from said tubular body, and crimpable retainers respectively integrally extending from said side neck walls in said longitudinal direction away from said tubular body, wherein said bottom barrel wall and said crimpable retainers together form a U-shape on a section plane perpendicular to said longitudinal direction, and wherein said crimpable retainers extend farther away from said bottom barrel wall to respective upper retainer edges of said crimpable retainers than said side neck walls extend away from said bottom neck wall to respective upper neck edges of said side neck walls.

2. The crimpable female electrical terminal according to claim 1, wherein said spring contact element includes a front element part integrally joined with said front end of said tubular body, a rear element part in said terminal cavity proximate to said rear end of said tubular body, and an intermediate element part integrally extending between said front element part and said rear element part, and wherein said notches have a notch depth extending in said longitudinal direction from said rear edges of said side walls, said notch depth being sufficient to reach a longitudinal position of said rear element part of said spring contact element.

3. The crimpable female electrical terminal according to claim 1, wherein said notches respectively have lower notch edges along said lower side wall portions, and wherein said lower notch edges are continuous with and on a same level as said upper neck edges of said side neck walls.

4. The crimpable female electrical terminal according to claim 3, wherein said lower notch edges and said upper neck edges all lie on a common plane that extends parallel to said bottom wall of said tubular body.

5. The crimpable female electrical terminal according to claim 1, wherein said bottom wall of said tubular body, said bottom neck wall, and at least a portion of said bottom barrel wall all lie on a common plane.

6. A crimpable female electrical terminal comprising:

an electrically conductive tubular body including a bottom wall, an upper wall spaced above said bottom wall, and two side walls spaced laterally from each other and respectively extending between said bottom wall and said upper wall, wherein a terminal cavity is formed within said tubular body between said bottom wall, said upper wall and said side walls, wherein said tubular body extends in a longitudinal direction from a front end of said tubular body defined by front edges of said side walls, said bottom wall and said upper wall to a rear end of said tubular body defined by rear edges of said side walls and said upper wall, wherein a respective notch is provided in each one of said rear edges of said side walls such that each said notch extends from a respective one of said rear edges in said longitudinal direction toward said front end so as to divide a respective rear portion of each respective one of said side walls into an upper side wall portion between said notch and said upper wall and a lower side wall portion between said notch and said bottom wall;

an electrically conductive spring contact element integrally extending from said front end of said tubular body into said terminal cavity in said longitudinal direction toward said rear end of said tubular body;

an electrically conductive neck including a bottom neck wall integrally extending in said longitudinal direction from said bottom wall at said rear end of said tubular body, and two side neck walls integrally extending in said longitudinal direction from said lower side wall portions at said rear end of said tubular body, wherein said side neck walls and said bottom neck wall together form a U-shape on a section plane perpendicular to said longitudinal direction; and an electrically conductive crimpable connection barrel including a bottom barrel wall integrally extending from said bottom neck wall in said longitudinal direction away from said tubular body, and crimpable retainers respectively integrally extending from said side neck walls in said longitudinal direction away from said tubular body, wherein said bottom barrel wall and said crimpable retainers together form a U-shape on a section plane perpendicular to said longitudinal direction, and wherein said crimpable retainers extend farther away from said bottom barrel wall to respective upper retainer edges of said crimpable retainers than said side neck walls extend away from said bottom neck wall to respective upper neck edges of said side neck walls; and wherein said spring contact element includes a front element part integrally joined with said front end of said tubular body, a rear element part in said terminal cavity proximate to said rear end of said tubular body, and an intermediate element part integrally extending between said front element part and said rear element part, and wherein said notches have a notch depth extending in said longitudinal direction from said rear edges of said side walls, said notch depth being sufficient to reach a longitudinal position of said rear element part of said spring contact element.

7. The crimpable female electrical terminal according to claim 6, wherein said notches respectively have lower notch edges along said lower side wall portions, and wherein said lower notch edges are continuous with and on a same level as said upper neck edges of said side neck walls.

8. The crimpable female electrical terminal according to claim 7, wherein said lower notch edges and said upper neck edges all lie on a common plane that extends parallel to said bottom wall of said tubular body.

9. The crimpable female electrical terminal according to claim 6, wherein said bottom wall of said tubular body, said bottom neck wall, and at least a portion of said bottom barrel wall all lie on a common plane.

* * * * *